US007699754B2

(12) United States Patent
Schneider

(10) Patent No.: US 7,699,754 B2
(45) Date of Patent: Apr. 20, 2010

(54) COMPLETE BODY FITNESS MACHINE

(76) Inventor: Kenneth George Schneider, 312 W. Hillcrest Blvd., Inglewood, CA (US) 90301

( * ) Notice: Subject to any disclaimer, the term of this patent is extended or adjusted under 35 U.S.C. 154(b) by 417 days.

(21) Appl. No.: 11/311,021

(22) Filed: Dec. 18, 2005

(65) Prior Publication Data

US 2006/0094570 A1 May 4, 2006

Related U.S. Application Data

(63) Continuation-in-part of application No. 10/153,943, filed on May 23, 2002, now Pat. No. 6,976,940.

(60) Provisional application No. 60/293,359, filed on May 24, 2001.

(51) Int. Cl.
*A63B 71/00* (2006.01)

(52) U.S. Cl. ..... 482/8; 482/1; 482/9; 482/91

(58) Field of Classification Search ..... 482/1–9, 482/51, 57.62, 115, 91, 92, 900–902; 434/247
See application file for complete search history.

(56) References Cited

U.S. PATENT DOCUMENTS 3,998,454 A 12/1976 Jones
4,765,613 A * 8/1988 Voris ..... 482/5
4,778,175 A 10/1988 Wucherpfennig
4,934,694 A * 6/1990 McIntosh ..... 482/9
4,934,695 A * 6/1990 Wolff ..... 482/133
5,074,551 A 12/1991 Olchansky
5,088,726 A 2/1992 Lapcevie
5,114,391 A * 5/1992 Pitzen et al. ..... 482/62
5,435,798 A * 7/1995 Habing et al. ..... 482/5
5,527,251 A 6/1996 Davis
5,580,340 A 12/1996 Yu
5,653,669 A 8/1997 Cheng
5,755,645 A * 5/1998 Miller et al. ..... 482/115
5,902,215 A 5/1999 Kuo
6,302,833 B1 10/2001 Ellis
6,361,476 B1 3/2002 Eschenbach
6,547,702 B1 4/2003 Heidecke (Continued)

*Primary Examiner*—Glenn Richman

(57) ABSTRACT

A "Complete Body Fitness Machine" that provides for a muscle building workout as well as a cardiovascular workout for the total body consists generally of an adjustable seat and two arms on either side, which are adjustable in height and have an infinitely and independently variable resistance possible in either clockwise or counterclockwise rotation. The arms are designed to have several types of mechanisms attached, so as to be able to work with a variety of body parts including, but not limited to, hands, arms, legs, feet, torso, neck and shoulders. When the proper attachment is used, the resistance for each direction of rotation of the arm is set, and the exercise is conducted. Depending on the workout desired, the seat and arms could be adjusted to different positions as well as the seat can be free-moving. This, combined with the fact that the arms can rotate 360-degrees, allows the user to simulate rotational cardiovascular exercises such as cycling, rowing, rotation of the arms in a circular motion (similarly to how the legs rotate in the cycling motion), and even running. The two independent arms are infinitely and separately adjusted for resistance in either rotational direction. This means that the body's natural design of using opposing muscle groups such as the bicep and triceps to bend and straighten the arm can be not only be utilized, but also maximized for efficiency of operation and workout.

10 Claims, 9 Drawing Sheets

U.S. PATENT DOCUMENTS 6,808,472 B1 * 10/2004 Hickman ..... 482/8
7,150,682 B2 * 12/2006 Varner ..... 473/257
2002/0072452 A1 * 6/2002 Torkelson ..... 482/51

* cited by examiner

COMPLETE BODY FITNESS MACHINE

CROSS-REFERENCE TO RELATED APPLICATIONS

This application is a continuation-in-part of U.S. patent application Ser. No. 10/153,943, which was filed on May 23, 2002, now U.S. Pat. No. 6,976,940 and which in turn was filed with benefit of Provisional Patent Application Ser. No. 60/293,359, filed May 24, 2001.

BACKGROUND

1. Field of this Invention

This invention relates broadly to an exercise apparatus and, more particularly, pertains to an exercise apparatus which is capable of performing a variety of efficient muscles building and toning exercises, and cardiovascular exercises in a single machine.

2. Discussion of Prior Art

Although there are a variety of multiple muscle exercise machines, they do not effectively combine a variety of muscle building exercises for the whole body with a variety of cardiovascular exercises for the major muscle groups of the body. Thus, until now, it hasn't been possible to find, within one machine, a true complete body workout for muscle building, toning, and cardiovascular training. Ellis et al. in U.S. Pat. No. 6,302,833 and Cheng in U.S. Pat. No. 5,653,669 describe machines built to provide for a variety of muscle building exercises. However, the setup does not provide for efficient exercise. The resistance/force provided is in one direction at a time. Thus, if a person wanted to exercise the muscles that push, and the muscles that pull back (as the arms will naturally need to do in order to return to their original position to repeat the pushing motion), which is the way all muscle groups in the human body work, it would require the changing the setup of the machine or the position of the person performing the exercise. The muscles that would "pull back" are actually in a state of constant relaxation. Even when returning to the original position on these machines, it would still be the muscles that "push" which are being used to resist the machine's force directed toward the return to the original position. Thus, one would be required to reverse their position, or change the setup, to work those muscles which "pull". This is a very inefficient use of workout time. Furthermore, the resistance is attached to a linear mechanism moving a weight up and allowing gravity to pull it down, so that it is impossible to workout in a complete rotational motion—thus achieving a cardiovascular workout similar to a bicycle motion. The machines are simply not designed to offer any type of true cardiovascular workout. In U.S. Pat. No. 5,580,340 the Multi-functional Exerciser is designed to provide a multi-muscle workout as well. But, once again, the limitations of a single direction resistance/force and the limit of a linear resistance mechanism result in a machine that doesn't offer both, a complete muscular and cardiovascular workout. U.S. Pat. Nos. 6,361,476 and 5,902,215 are both examples of cardiovascular exercise machines which apply rotational resistance technology, but are limited to one exercise, and provide no design for targeted muscle building exercise.

A simple trip to the local gym, someone's home gym, or a late night infomercial viewing, will demonstrate that there exists a large variety of exercise equipment that is geared toward exercising people in a cardiovascular way—working the legs and upper body in a rotational fashion, as well as a large variety of machines targeted at working on muscle building—either targeting individual muscles with a single machine, or multiple muscles with a universal machine similar to the previously mentioned U.S. Pat. No. 5,653,669 by Cheng. It is evident that, until the production of the present invention, there doesn't exist a machine that will, as efficiently as possible, allow for the targeting of all major specific muscle groups for exercise, as well as address the need for an extended cardiovascular exercise within one machine. The present invention, with its design offers the capability to work both the "pushing" and "pulling" muscles of opposing muscle group sets such as bicep and triceps during the same exercise. This reduces the potential workout time in half, as well as offering the cardiovascular workout advantages. These are two critical components recommended by fitness experts, but, until the present invention, not offered in one simple machine.

BACKGROUND OF INVENTION

Fitness machines are generally designed to work on building muscle mass through the repetition of movements by providing a greater resistance against movement in a particular direction, or build muscle tone by providing medium resistance against movement, or work on building cardiovascular strength through a lower resistance and higher repetition of movement. Most muscle building machines are designed to work a specific muscle such as the bicep, pectoral muscle, hamstring, or calf muscle. Some machines are designed to work a variety of muscle groups, but require the operator to change position and motion frequently to change the muscle group targeted for exercise. This reduces the efficiency and convenience of obtaining a total body workout for building muscles. It is well known that a person is more likely to continue a workout routine if it is convenient and enjoyable. Generally, machines that provide for specific muscle building programs do not provide a means of getting a cardiovascular workout—thus creating a need for multiple machines to achieve both a muscular building and cardiovascular workout. An example of this would be a muscle-building machine such as a bench press or leg press machine that is designed to build pectoral or thigh muscles, but doesn't provide the sustained cardiovascular workout of a stationary bicycle. Until now, there hasn't been a single machine that effectively provides for muscle building of all major muscle groups and a variety of cardiovascular workouts. The "Total Body Fitness Machine" is exactly that!

SUMMARY OF INVENTION

Although there are machines that offer an infinitely variable resistance, they are one dimensional, and do not take advantage of the way the body was designed to work—by utilizing opposing muscle groups. The best way to understand this is through example:

Exercising the major muscles in the arm, the bicep and triceps, are a simple example. The way the arm works is that the bicep flexes to bend the arm while the triceps relax, and conversely, the triceps flex while the bicep relaxes to straighten the arm. Machines that exist today work the bicep by applying resistance against the bending of the arm and the triceps relax throughout the workout. Then, in order to work the triceps, one must change machines, mechanisms, or at least positions. The unique design of the "Total Body Fitness Machine" provides an independent, infinitely variable resistance to either clockwise or counter-clockwise rotation. Thus, the resistance to the bending and straightening of the arm is set separately but simultaneously—providing independent and infinitely variable resistance against movement in both directions. This makes for a very efficient and more effective workout targeting muscle group pairs—as the body was designed to function, and cutting the time necessary to work the same number of muscles as other machines in half. It allows a person to individually adjust the resistance in both directions, thus creating proper resistance as the arm is bent—working the bicep, and creating the possibility of setting a different resistance to movement in the other direction—working the triceps. This means that both muscle groups are worked during the single exercise, where on a traditional system, two separate mechanisms are required to achieve the same goal. Since the resistance in either direction operates independently, one can take into account that opposing muscle groups often have different strengths. As an example, one could set the resistance for the bicep motion to fifty pounds and the triceps' resistance to forty pounds, thus maintaining a proper proportional workout. Another advantage of working in this way is that one will have resistance through the complete range of motion in both directions. If one is working the bicep alone, generally there isn't a consistent resistance through the whole motion. Since there is going to be a resistance in the other direction as well, one will be inclined to work the complete range of motion without "cheating" and stopping short to relax, as there is no relaxation due to the fact that the opposing muscle group must start flexing right away. The end result is that both muscles which control the arm get a complete workout with the benefit of leading to strengthening throughout one's entire range of motion, in a simple and efficient manner.

In addition to the great benefits of the independently and infinitely variable resistance of the present invention, the mechanisms that provide the resistance allow for a 360-degree rotation. Muscle building equipment operates utilizing a linear mechanism by requiring the user to move against a resistance, generally against a weight, band, or spring. This mechanical motion is limited due to the fact that the weight, band, or spring can only move a certain linear distance, and must be returned to its original position in order for the exercise to be repeated. This may, depending on is body size, limit the range of motion of the user. In addition, this type of resistance requires only one side of the opposing muscle groups to work as the weight or band is moved from, and returned to, its place of rest. The "Total Body Fitness Machine's" unique ability to rotate continually 360-degrees has no limitations in its range of motion because the resistance is not connected to a linear component such as a weight that must be returned to its original position to repeat an exercise. This allows the user to operate the machine not only as a muscle-building piece of equipment for the entire body, but also as a cardiovascular exercise piece of equipment simulating repetitive motions such as cycling, rowing, rotation of the arms in a circular motion (similarly to how the legs rotate in the cycling motion), and even running. In fact, any of the exercises on the machine can be set with a lower resistance in both directions so that all exercises can be done in high repetitions to build cardiovascular strength. Each 360-degree rotational resistance device operates independently, so as to offer a better workout. An example would be a comparison with a stationary bicycle. Generally, one is only focusing on the pushing of the pedals in a downward direction for each leg. This is due to the fact that the pedals are connected to the same crank. One really only works the quadriceps (thighs) because the hamstring relaxes as the other leg's quadriceps push down. This leads to the building of only one side of a leg's opposing muscle groups. Many muscle injuries, such as strains and pulls, in sports are actually the result of one's opposing muscle groups not being proportionally strengthened. On the "Total Body Fitness Machine" the exercise would actually require the person to apply a force throughout the entire range of motion for each leg separately, thus building both the muscle groups that straighten and bend the leg.

The machine is structured so that the seat and the resistance arms are adjustable in a variety of ways allowing a wide range of setup possibilities to target different muscle groups such as arms, legs, pectorals, and back to name a few. It is also possible to add a variety of attachments to the lever arms to increase the potential of exercise possibilities. This allows the implementation of the 360-degree rotational movement and the independently variable resistance to clockwise and counterclockwise motion toward the conditioning of all major muscle groups of the entire body. The "Total Body Fitness Machine" is the only unit which, using its unique 360-degree rotational movement and independently variable resistance to clockwise and counterclockwise motion, allows the user to workout virtually all of the muscles in the arms, torso, and legs with an almost limitless variety of exercises. These unique features allow a user to work with higher resistance—building muscle mass, medium resistance—building muscle tone, and lower resistance—building cardiovascular strength through continued repetitions over a sustained timeframe. Finally, we have one machine that effectively and efficiently joins the complete muscular workout with the complete cardiovascular workout. The components of the apparatus will be fully described in the following detailed description.

Objects and Advantages

Accordingly, several objects and advantages of my invention are:

a) that it is a simple machine with few necessary adjustments required to provide and almost unlimited quantity of muscular and cardiovascular exercises all within one machine;

b) that it offers two mechanisms which operate independently, and can be variably and separately adjusted to resist both clockwise and counter-clockwise motion with different forces allowing for a quick and efficient workout utilizing the body's natural design of opposing muscle groups to operate any joint in the body;

c) that its resistance mechanisms works on a rotational platform so complete 360-degree movement is possible—thus resulting in the potential of a variety of low resistance cardiovascular exercises such as a cycling motion to be performed;

d) that the machine's structure allows for the adjustments of the various parts which make it easily accessible for just about anyone to position themselves, or the resistance arms, to achieve a large variety of exercises—targeting a very specific muscle group or a variety of muscle groups; and e) the machine can interconnected with a computer network.

DRAWING FIGURES

DETAILED DESCRIPTION OF THE PREFERRED EMBODIMENT

The various, non-resistance, parts of the apparatus shall be molded or tooled out of metal or plastic or other similar material that shall be comfortable to operate during exercise, provide for the necessary function it was designed for, as well as offer enough strength to withstand normal daily use. The resistance mechanism will be made of materials that could vary depending on whether the force is achieved electrically, magnetically, via friction such as a brake or belt, or by some other means of variable resistance, but will generally allow for the safe operation of the part within the complete machine.

Figure 1:
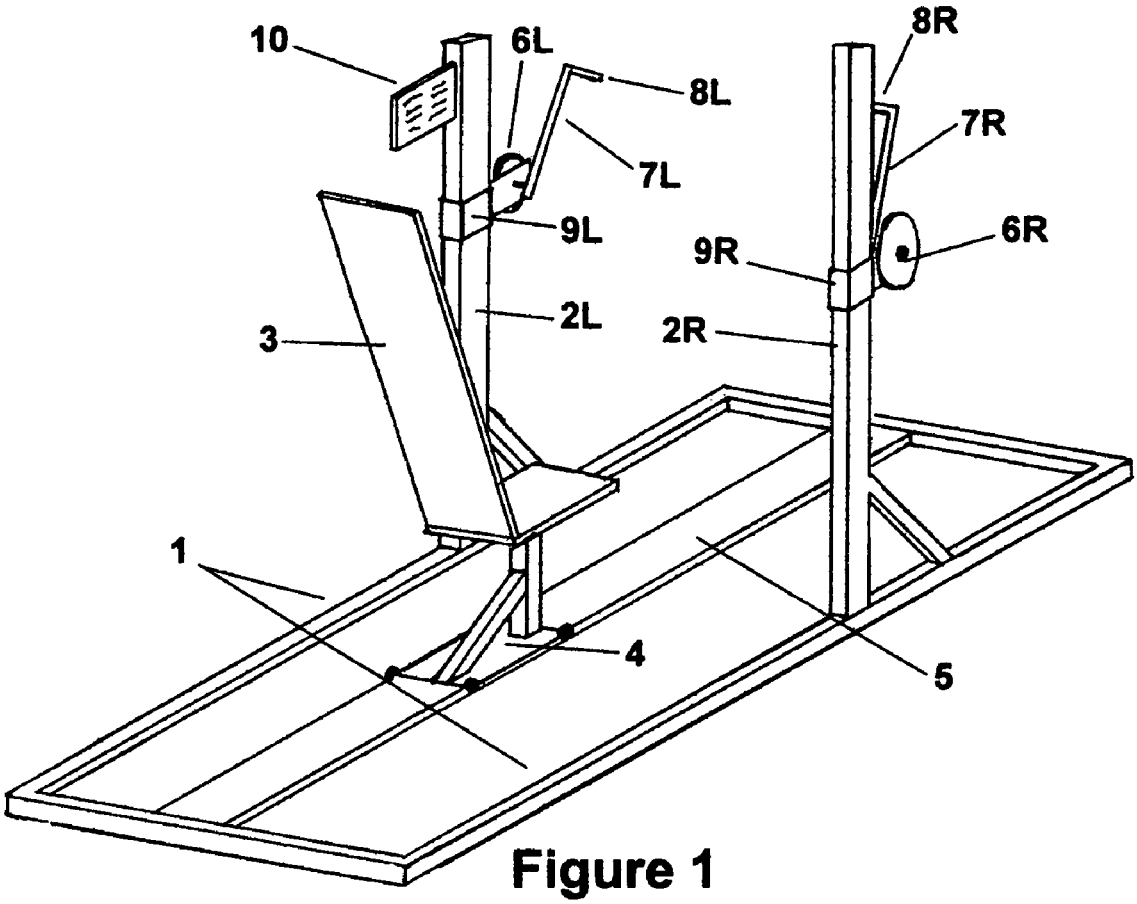
FIG. 1 is a perspective view of a complete body fitness machine of preferred embodiment in accordance with the present invention.

With reference to the drawing FIG. 1, the complete body fitness machine according to the present invention mainly comprises a base 1, upright supports 2L (left) and 2R (right), a seat assembly 3, a support assembly for the seat 4, an assembly to secure the seat and it's support assembly to the frame 5, resistance generating mechanisms 6L (left) and 6R (right), lever arms 7L (left) and 7R (right), handles 8L (left) and 8R (right), and support assemblies for resistance generating mechanism, lever arms, and handles 9L (left) and 9R (right), and a mechanism for adjusting resistance of resistance mechanisms 10. This adjustment is done through a graphical user interface on 10.

The frame is made up of a rectangular base 1, upright supports 2L (left) and 2R (right), and a support connected to either end of the rectangular frame 1 in the middle of the rectangular base 5. The seat support 4 is attached to the support in the middle of the frame 5. The seat assembly 3 is attached to the seat support 4.

The resistance mechanisms 6L (left) and 6R (right) are attached to the support assemblies 9L (left) and 9R (right). The lever arms 7L (left) and 7R (right) are attached to the resistance mechanisms 6L (left) and 6R (right). The handles 8L (left) and 8R is (right) are attached to the lever arms 7L (left) and 7R (right). The support assemblies 9L (left) and 9R (right) are attached to the upright supports 2L (left) and 2R (right).

The mechanism 10 that controls the resistance mechanisms 6L (left) and 6R (right) is attached to support upright 2L.

Figure 2:
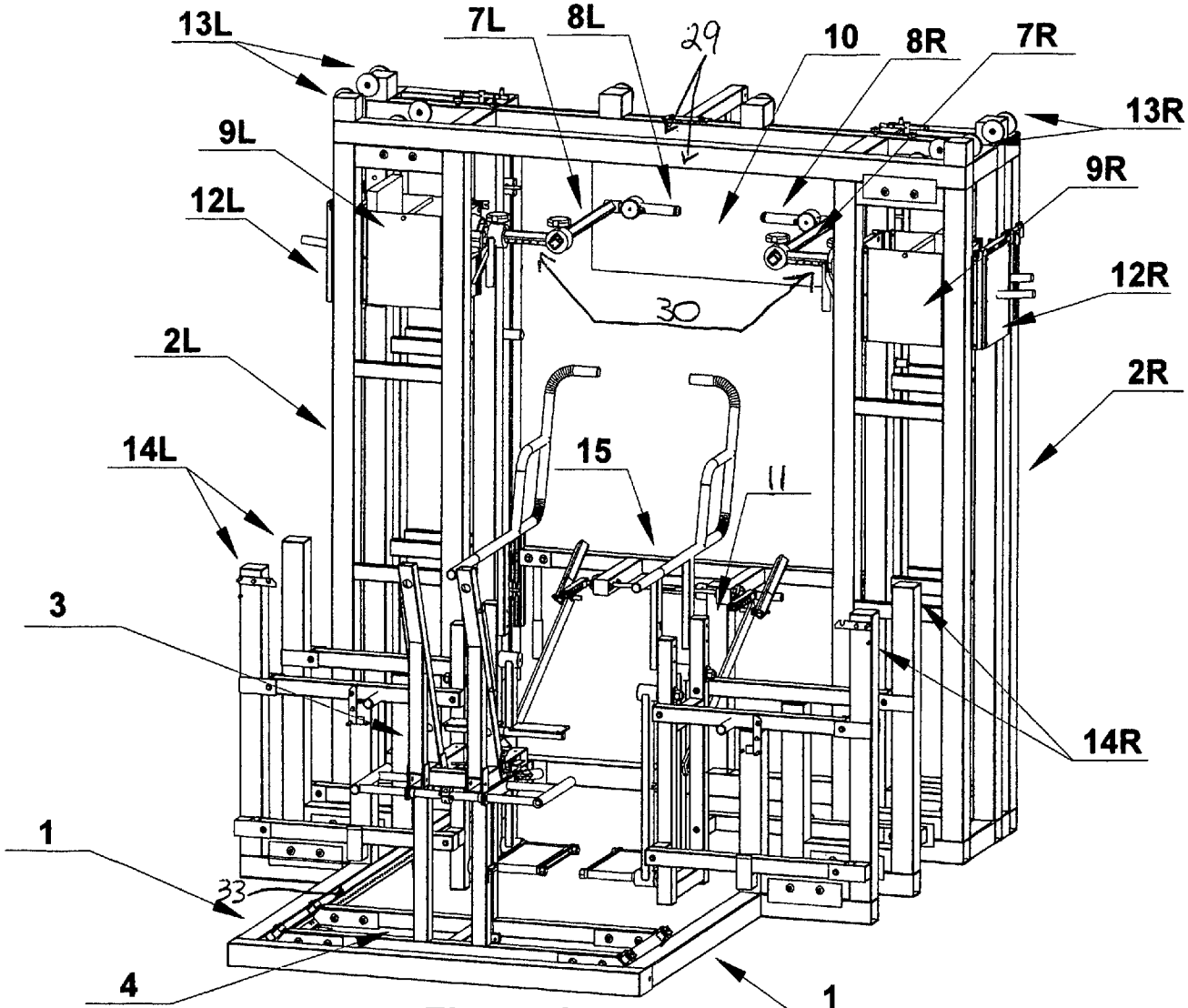
FIG. 2 is a more detailed perspective of FIG. 1 with the addition of some attachments to offer a variety of workout possibilities. Additional upright supports have been added to provide for greater strength in the machine.
Figure 3:
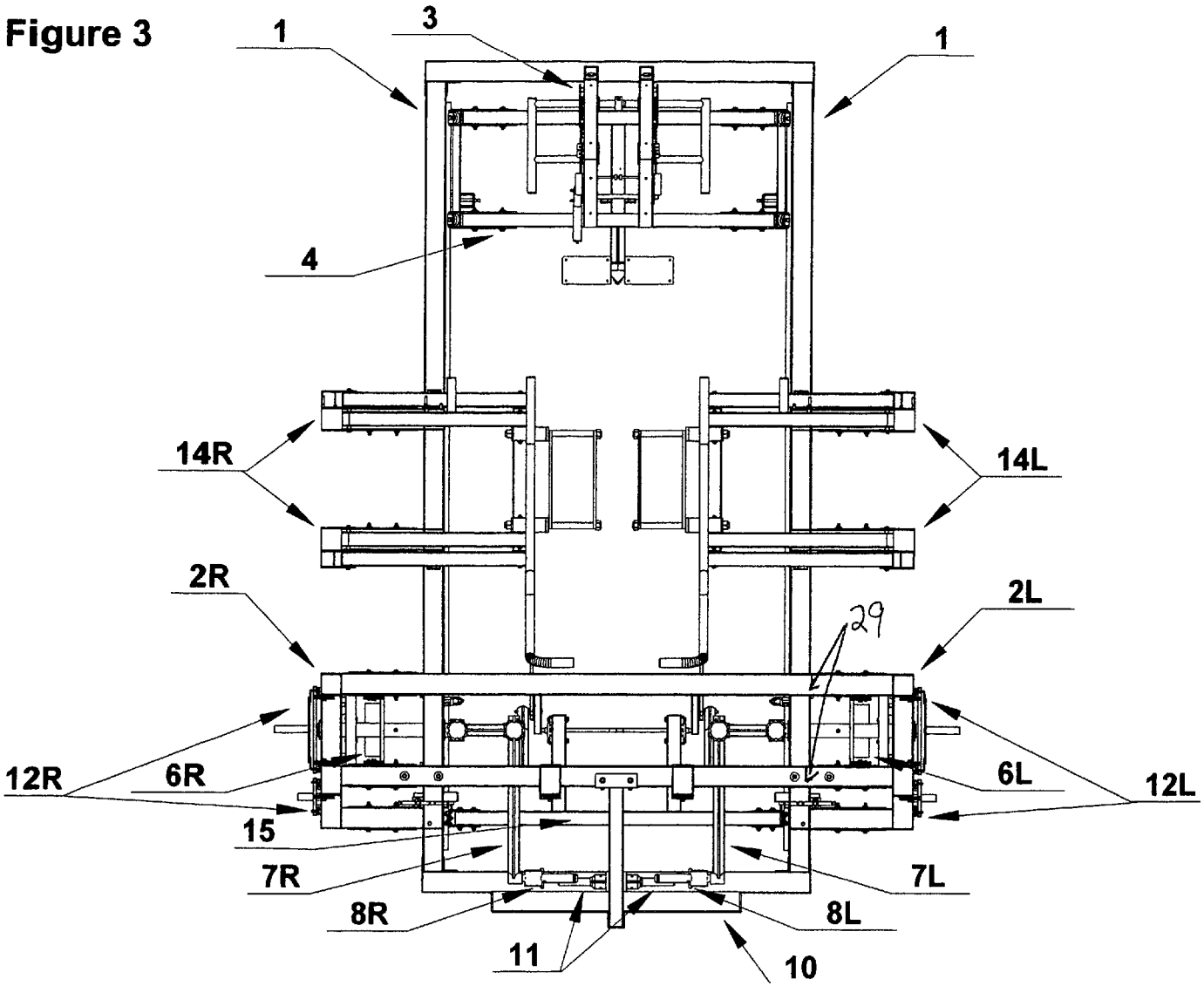
FIG. 3 is a plan view of FIG. 2 to help understand all of the parts.

With reference to the drawing FIG. 2 and FIG. 3, more detailed versions of FIG. 1, shows the fitness machine with some attachments. In order to achieve more stability additional support structures have been added to the upright supports 2L and 2R and the seat support structure 4. Uprights 2L and 2R are made up of four supports. These supports provide strength to provide stability against torque in any direction that is created by the resistance brakes 6L and 6R during exercise. Another structure 29 is comprised of two horizontal supports attached to the top of the upright supports 2L and 2R. This will provide a complete frame creating an extremely strong frame which won't move or flex during exercise. FIG. 1 number 5, connected to the either end of the base 1 has been removed, and the seat support structure 4 connects directly to the frame 1. Again, this adds greater strength and won't allow for any undesired flex or movement during exercise. The control mechanism 10 from FIG. 1 number 10 has been moved so the user can view it more easily during exercise, and will be accessed using direct touch control and/or remote control. The additional detail of FIGS. 2 and 3 demonstrate the addition of several accessories which allow for a variety of exercise. 11 is a post which will allow for quick release pedals FIGS. 7 and 8 to be attached. The user will secure his/her feet in the pedals, and, while sitting on the seat 4 will be able to perform an exercise simulating rowing. 12L and 12R are ballast weight holder that are connected to the support assemblies 9L and 9R (only shown in FIG. 2) and the brake connector assembly 15. By using ballast weights the user will be able to adjust the height of the support assemblies 9L and 9R and the brake connector assembly 15 using very little force—much like the ballast weights function in an elevator. These connection between these ballast weights and their corresponding assemblies is achieved using a cable attached to each and running over pulleys 13L and 13R (only shown in FIG. 2). The brake connector's 15 function is to connect the rotation of each individual side of the machine to add to the machine's capability to provide a variety of exercises. Such exercises might include activities such as pedaling while seated, striding while standing or pushing with one's legs while seated. All of these exercises require the user legs to move synchronously, so it will be more functional to have the shafts of each side functioning as if they were one. The brake connector 15 will, when desired, be lowered down and locked into place. The resistance brake shafts 30 will then be attached to each brake connector. 14L and 14R are strider assemblies located in their down and functioning position. A person will be able to stand on these and perform a striding motion. When not in use, they will be lifted and locked into the upright position so the seat assembly FIG. 4 will be free to move along the complete base.

The height, length and width of the lever arms can be adjusted so that the user will be able to perform the desired exercises properly. The width will be adjusted as the resistance brake shafts 30 slide in and out through the hollow shafts that support the brakes X. Screw handles clamp when the desired position is achieved. In a similar fashion, the length of the lever arms 7L and 7R are adjusted and secured. The height is locked into place using a similar system as the chair assembly FIG. 4 parts 19 and 20 where locking pins secure the height. This ensures that the height can not be accidentally changed regardless of the force applied.

Figure 4:
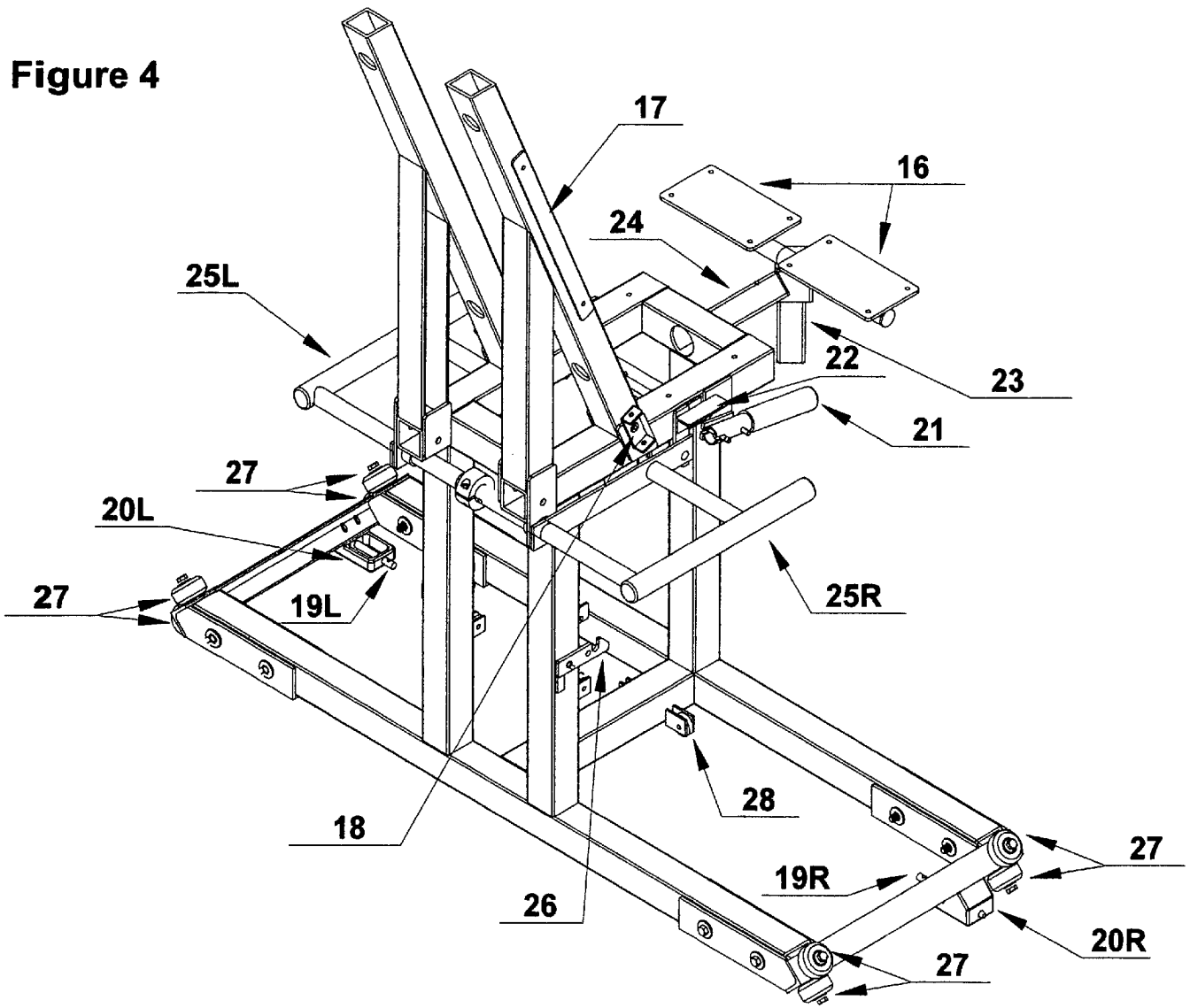
FIG. 4 is a detailed perspective view of the seat assembly 3 and 4.

The seat assembly FIG. 4 will lock into place when necessary via locking pins 19L and 19R. These locking pins are spring loaded and secured in the locking mechanism supports 20L and 20R. The locking pins are connected using a cables, and attached to handle release lever 21. The cables run though pulleys 28 (the left pulley for the left side cable is not easily visible but does exists). The natural position for the lever 20 is down as shown. This allows the spring loaded locking pins 19L and 19R to extend into the base frame 1. By locking the seat assembly FIG. 4 on both sides, it will be unable to move or flex. When the user desires to move their position the handle release lever 21 is lifted. The result is that the locking pins 19L and 19R are pulled in and the seat assembly is free to roll on its wheels 27 to another desired position. When in place the user can release the handle and the locking pins will extend into holes 33 (holes in the right side of the base are not visible but exist) located along the base frame—locking it into position. If the user desires to allow the seat assembly FIG. 4 to move freely so as to use the fitness machine in the rowing capacity, then the handle release lever 21 need only to be raised higher and it will lock into place. Pushing a button (not pictured) on the end of the handle release lever 21 will release the lock, and allow the handle release lever to rotate down—locking the seat assembly FIG. 4 into position. The wheels 24 on the seat assembly FIG. 4 are positioned to oppose each other so the chair can not come off the track regardless of the direction of force applied to it. Arm rests 25L and 25R are shown in the up position. This will allow the user to have a place to support his/her arms during exercises using his/her legs. While performing arm exercise, this position will restrict the arm's motions. The user can lift lever 22 to release the arm rests 25L and 25R. The arm rests 25L and 25R can then be rotated down and locked into place in the locking plate 26 (the left is not visible in the drawing but does exist). When the user wants to put the arm rests 25L and 25R back into place, lever 22 is lifted again. The arm rests 25L and 25R will be free to relocate back in the up position where they will lock into place in the same fashion as using the locking plate 26. In order to provide for all different body types, the leg supports 16 can be adjusted in height by raising up or lowering the vertical bar 23 and tightening it into place. The length can also be adjusted in the same fashion by moving the horizontal bar 24 out or in and tightening it into place. This will allow the machine to accommodate people who are short, tall, and anywhere in-between.

Depending on the desired lever arm handle 8L and 8R position there is a possibility to adjust this position. With reference to the drawing FIG. 5 and FIG. 6 the handle will be attached to lever arms 7L and 7R of FIGS. 1, 2, and 3 respectively using a bolt screwed into the handle holder 211 at point 214. The part that the user will hold on to 212 will be attached to the handle holder 211 by a bolt 213. This will allow the part 212 to rotate. This part 212 will be locked into place by the locking pin 219. The locking pin 219 is pushed into place by a rod 216 that fits inside the handle. This rod 216 is continuously pushed by the spring 217. A screw 218 screws into the end of the part the user holds 212 compressing the spring and providing the force on the rod 216. If the user requires an adjustment of the angle, the locking pin 219 is pulled away from the handle holder 211 in the slot 220 as the part is rotated. Once the desired position is reached the user will let go of the locking pin 219 and it will be pushed back into one of the grooves 215. If the user desires the part they hold 212 to move freely then they can simply rotate the locking pin 219 and release it in the receiving area of the groove 220. The locking pin 219 can be rotated back and released so the part the user holds 212 will be locked back in the desired location. The end of the part the user holds 212 is angled 221 and has a groove 222. This is to allow for a quick release mechanism to lock into place. A variety of attachments will be able to slide over the part the person holds 212 and quickly lock into place by snapping into the groove 222.

Figures 5, 6:
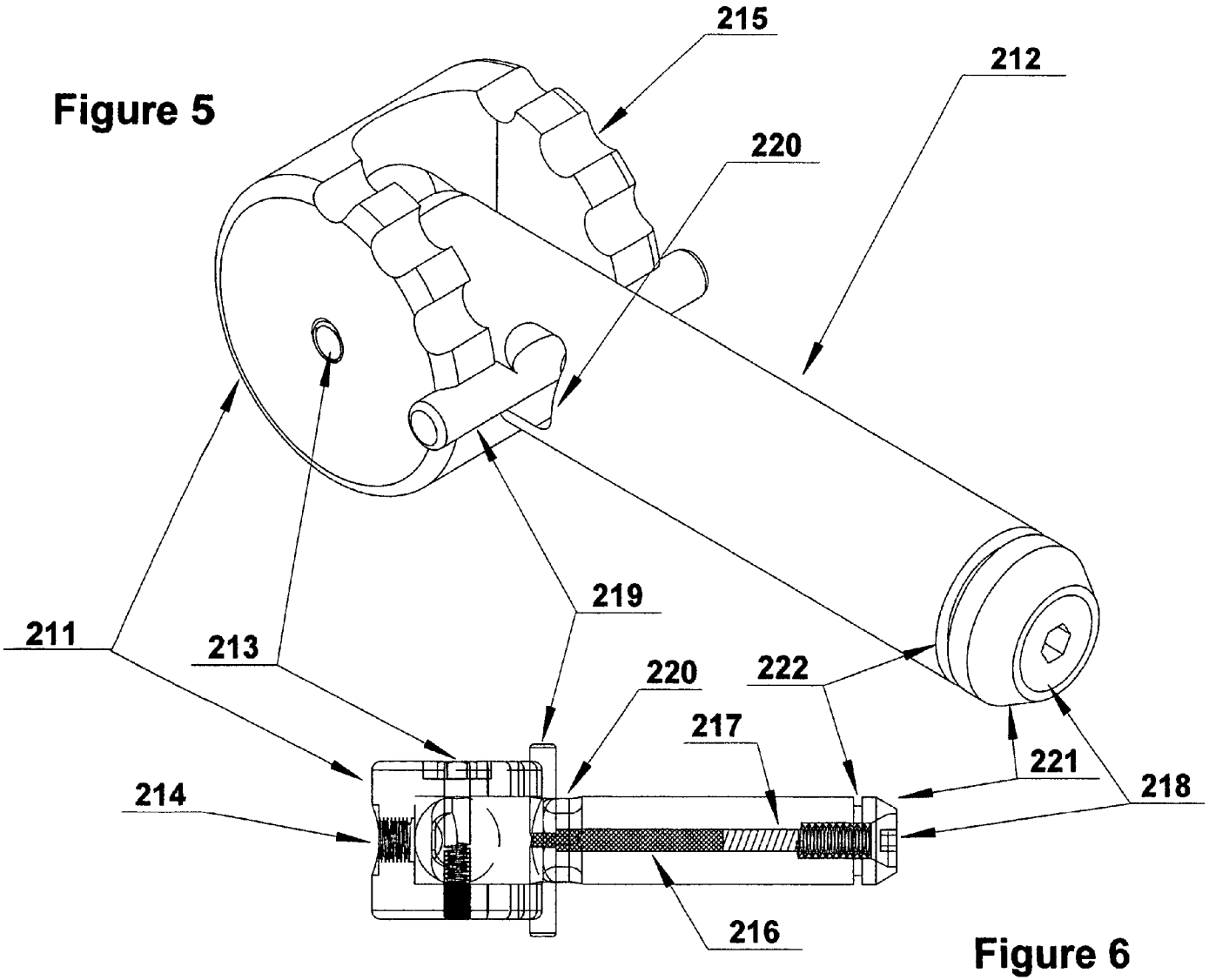
FIG. 5 is a detailed perspective view of the lever arm handles 8L and 8R. The handles are mirror copies of each other and function identically so only one is pictured.
FIG. 6 is a detail plan view of the lever arm handles 8L and 8R. The handles are mirror copies of each other and function identically so only one is pictured.
Figures 7, 8:
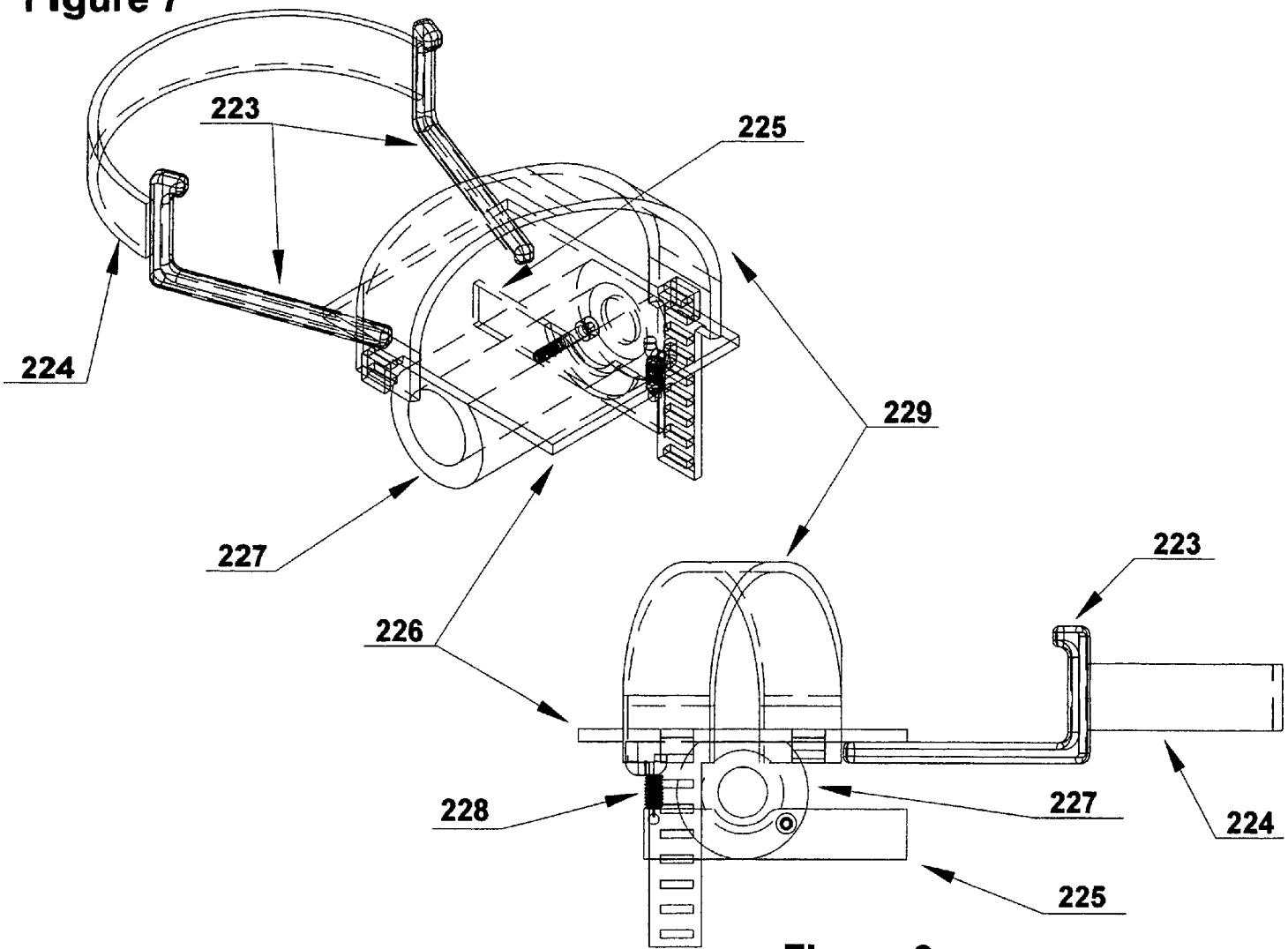
FIG. 7 is a detail perspective view of the quick release pedal assembly. The pedals are mirror copies of each other and function identically so only one is pictured.
FIG. 8 is a detail plan view of the quick release pedal assembly. The pedals are mirror copies of each other and function identically so only one is pictured.

One such attachment could be a pedal FIGS. 7 and 8. This quick release pedal has a place that the ball of the foot will rest 226. Adjustable straps 224 and 229 will secure the user's foot into place so that, regardless of the direction of force, the foot will always stay securely on the pedal. The pedal FIGS. 7 and 8 will slide into place over the part of the lever arm handle 212 that the person holds. As it slides into place the locking plate 224 will come into contact with the sloped edge of the handle 221 (FIGS. 5 and 6). As the pedal receptacle 227 is pushed further onto the handle the locking plate 225 is forced open. Once the pedal is on far enough the locking plate 225 is pulled down into the groove 222 on the handle by the spring 228. The pedal is now locked onto the handle. To remove the pedal the user pushes on the end of the locking plate 225 opposite the spring 228. This allows the pedal to slide off of the handle 212. With the pedals attached to the lever arm handles, the user can perform a variety of exercises such as leg curls and extensions.

Figure 9:
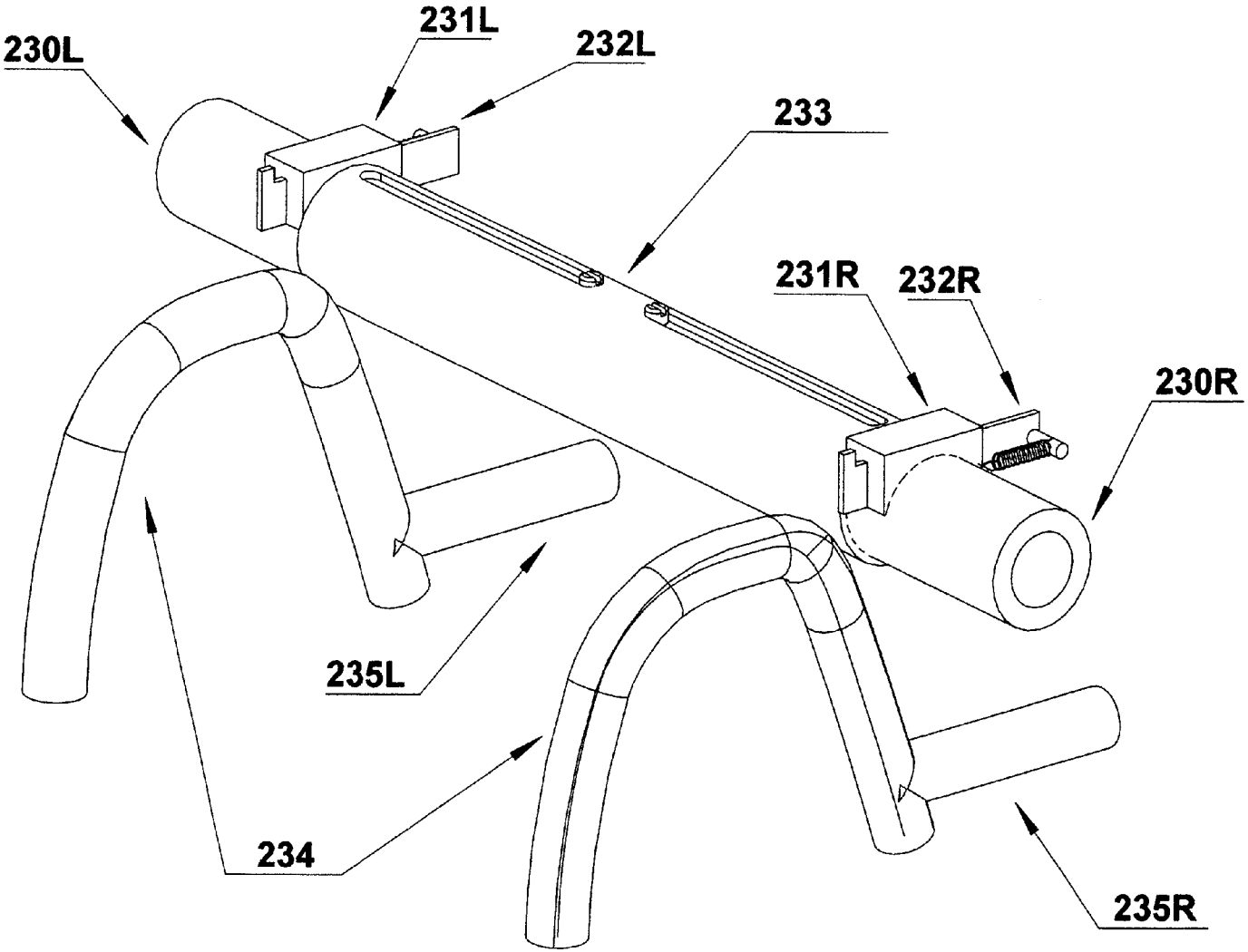
FIG. 9 is a detail perspective of the quick release abdominal attachment.

The user could perform a variety of abdominal exercises using the quick release abdominal attachment in FIG. 9. In a similar way as the pedal attachment FIGS. 7 and 8 is the user would attach the sliding tube 230L and 230R by sliding them over the part the user holds 212 FIGS. 5 and 6 and locking them into place where locking plates 232L and 232R will slide open and then close in the groove of the handle. The sliding tubes 230L and 230R move freely inside the outer tube 233. Once the attachment is locked on the user will adjust the lever arms FIGS. 1, 2 and 3 so the shoulder harnesses 234 fit comfortably over the shoulders. The user will then place their hands at rest on the handles 235L and 235R. The user can now perform abdominal and back strengthening exercises by leaning forward and straightening back up against resistances. The sliding tubes 230L and 230R move freely allowing the length of the attachment to get longer, so the user can rotate as well working the oblique muscles as well as the back muscles. When the user is done, the attachment is released by pushing the locking plates 232L and 232R and pushing the sliding tubes 230L and 230R inward. By utilizing the quick release technology a large variety of attachments could be developed to allow for the performance of exercises limited only by the imagination.

Operation

The frame, composed of 1, 2, and 5 is designed to provide a rigid support system for the machine's parts. The seat assembly 3 will support the person during exercise. The seat is secured to the frame support 5 through its support assembly 4. This will keep the seat assembly 3 and its support assembly in proper position during exercise. The seat can be locked into place at any point along the support 5, or allowed to move freely along the support 5, depending upon the desired setup for a particular exercise. Once in place on the seat, the support assemblies 9L (left) and 9R (right) shall be adjusted to the proper height on upright supports 2L (left) and 2R (right) so that the lever arms 7L and 7R and handles 8L and 8R will be at a comfortable and correct position for the desired exercise. The mechanism for controlling the resistance to clockwise and counterclockwise rotation shall be set independently. The unit, whether mechanical, or electrical, will determine the direction of rotation, speed, position, and any other input from additional sensors, and adjust the resistance according to the desired settings. The machine is now ready for exercise. The positions and settings may be varied throughout the workout for the performance of many different exercises.

Conclusions, Ramifications, and Scope

Thus the reader will see that the "Complete Body Fitness Machine" is the only machine that simply and effectively provides for the opportunity for someone to exercise opposing muscle groups within the same exercise, but having the ability to work against different forces for each of the opposing muscle groups within said given exercise. In addition, the "Complete Body Fitness Machine" is the only machine that combines the said variable resistance capabilities with the opportunity to have a continual 360-degree rotation of the resistance lever, allowing for cardiovascular exercise as well as muscle building exercise. This is truly a complete body fitness machine offering an almost limitless variety of muscle building and cardiovascular system building potential all within one simple and easy to use machine.

While my above description contains many specificities, these should not be construed as limitations on the scope of the invention, but rather as an exemplification of one preferred embodiment thereof. Many other variations are possible. For example, the resistance mechanisms may be electrical, fluid, friction, or some other means of creating a resistance to movement in design, or the means for controlling these resistance mechanisms may be digital, analog, or mechanical, and end result will be the same.

As discussed above, the "Complete Body Fitness Machine" has sensors that detect speed, direction, and position, and feed that information to a computer mechanism that interprets that data and assigns the proper resistance. This data can in turn be fed into a computer network. Likewise, a computer network can be utilized to control the machine.

Operating Environment

A. Remote Terminal and Network

Figure 10:
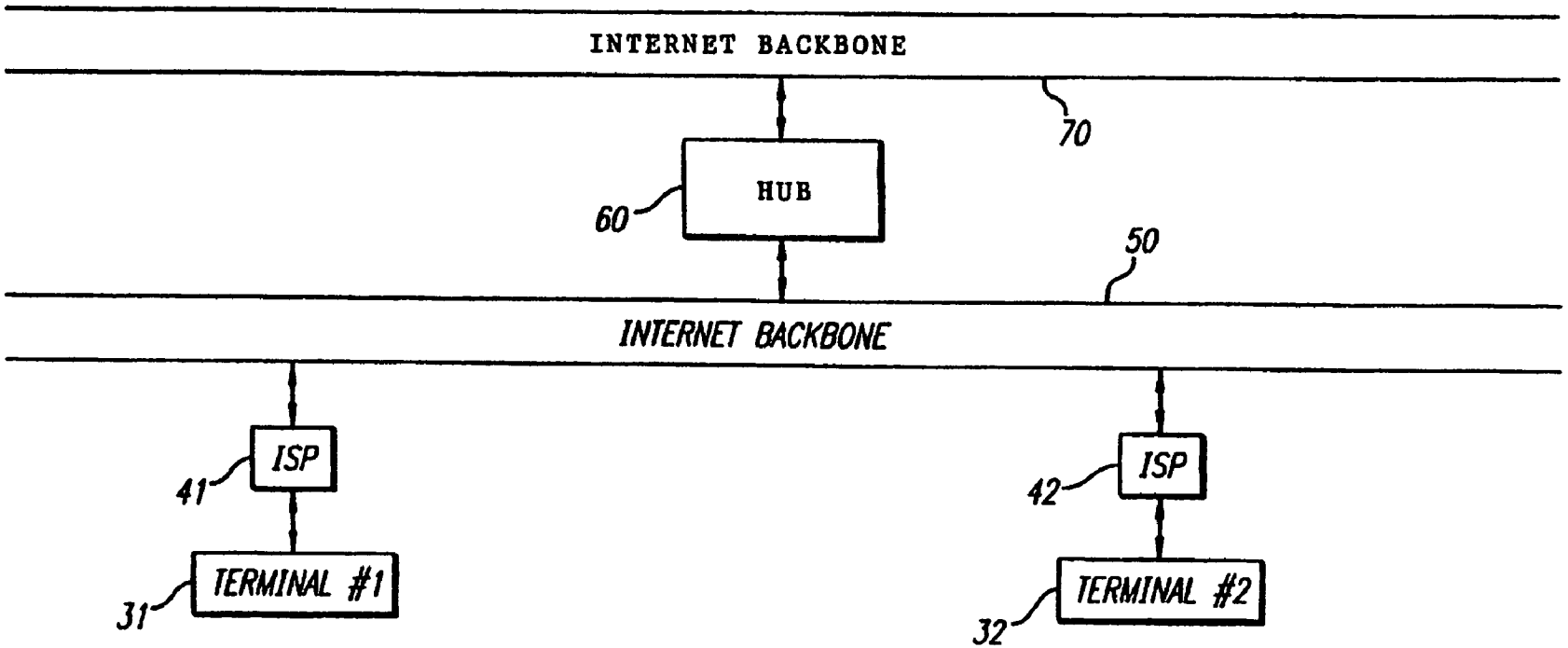
FIG. 10 is a block diagram illustrating the structure of the preferred network in which the present invention can operate.

FIG. 10 is a block diagram illustrating the structure of the preferred network in which the present invention can operate. Shown in FIG. 10 are terminals 31 and 32, each of which may comprise an ordinary computer workstation, a laptop computer, or special-purpose computing equipment. Here, terminal 31 is directly connected to the exercise machine. In the preferred embodiment, terminal 31 receives information from the machine, such as sensors that detect the heart rate of the user or the speed of rotation. In the preferred embodiment, it can also control the exercise machine. Terminal 32 can be a computer at a third-party service provider, such as a health club, an insurance company or a physician's office. Terminals 31 and 32 communicate with Internet service providers (ISPs) 41 and 42 via a telephone connection, such as by using a modem interface. ISPs 41 and 42, in turn, connect to Internet backbone 50 via their respective routers (not shown). Specifically, ISP 41 receives Internet messages from terminal 31 and then routes them onto Internet backbone 50. Also, ISP 41 pulls messages off Internet backbone 50 that are addressed to terminal 31 and communicates those messages to terminal 31 via the telephone connection. In a similar manner, terminal 32 also can communicate over the Internet through ISP 42. Of course, such terminals may also connect directly to Internet backbone 50 if provided with the appropriate routers and other hardware.

Figure 11:
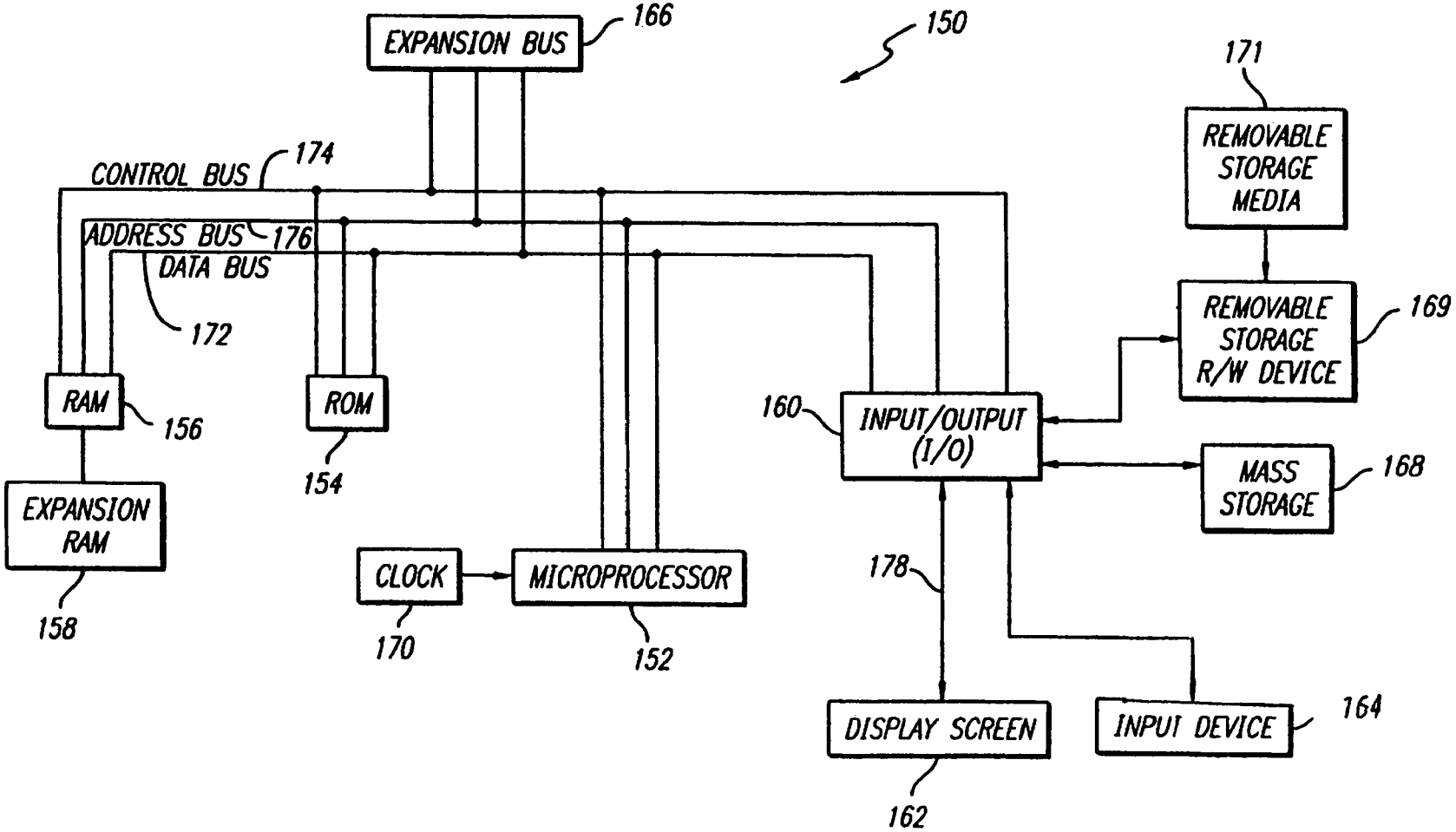
FIG. 11 illustrates a block diagram of a general purpose computer system which can be used to implement terminals 31 and 32.

FIG. 11 illustrates a block diagram of a general purpose computer system which can be used to implement terminals 31 and 32. Specifically, FIG. 11 shows a general purpose computer system 150 for use in practicing the present invention. As shown in FIG. 11, computer system 150 includes a central processing unit (CPU) 152, read-only memory (ROM) 154, random access memory (RAM) 156, expansion RAM 158, input/output (I/O) circuitry 160, display assembly 162, input device 164, and expansion bus 166. Computer system 150 may also optionally include a mass storage unit 168 such as a disk drive unit or nonvolatile memory such as flash memory and a real-time clock 170.

CPU 152 is coupled to ROM 154 by a data bus 172, control bus 174, and address bus 176. ROM 154 contains the basic operating system for the computer system 150. CPU 152 is also connected to RAM 156 by busses 172, 174, and 176. Expansion RAM 158 is optionally coupled to RAM 156 for use by CPU 152. CPU 152 is also coupled to the I/0 circuitry 160 by data bus 172, control bus 174, and address bus 176 to permit data transfers with peripheral devices.

I/O circuitry 160 typically includes a number of latches, registers and direct memory access (DMA) controllers. The purpose of I/0 circuitry 160 is to provide an interface between CPU 152 and such peripheral devices as display assembly 162, input device 164, and mass storage 168.

Display assembly 162 of computer system 150 is an output device coupled to I/O circuitry 160 by a data bus 178. Display assembly 162 receives data from I/O circuitry 160 via bus 178 and displays that data on a suitable screen.

The screen for display assembly 162 can be a device that uses a cathode-ray tube (CRT), liquid crystal display (LCD), or the like, of the types commercially available from a variety of manufacturers. Input device 164 can be a keyboard, a mouse, a stylus working in cooperation with a position-sensing display, or the like. The aforementioned input devices are available from a variety of vendors and are well known in the art.

Some type of mass storage 168 generally is considered desirable. However, mass storage 168 can be eliminated by providing a sufficient mount of RAM 156 and expansion RAM 158 to store user application programs and data. In that case, RAMs 156 and 158 can optionally be provided with a backup battery to prevent the loss of data even when computer system 150 is turned off. However, it is generally desirable to have some type of long term mass storage 168 such as a commercially available hard disk drive, nonvolatile memory such as flash memory, battery backed RAM, PC-data cards, or the like.

A removable storage read/write device 169 may be coupled to I/O circuitry 160 to read from and to write to a removable storage media 171. Removable storage media 171 may represent, for example, a magnetic disk, a magnetic tape, an opto-magnetic disk, an optical disk, or the like.

In operation, information is input into the computer system 150 by typing on a keyboard, manipulating a mouse or trackball, or "writing" on a tablet or on a position-sensing screen of display assembly 162. Also, voice activation means can be utilized to input information into the computer system 150. CPU 152 then processes the data under control of an operating system and an application program, such as a program to perform steps of the inventive method described below, stored in ROM 154 and/or RAM 156. CPU 152 then typically produces data which is output to the display assembly 162 to produce appropriate images on its screen.

Expansion bus 166 is coupled to data bus 172, control bus 174, and address bus 176. Expansion bus 166 provides extra ports to couple devices such as network interface circuits, modems, display switches, microphones, speakers, etc. to CPU 152. Network communication is accomplished through the network interface circuit and an appropriate network.

Suitable computers for use in implementing the present invention may be obtained from various vendors. Various other types of computers, however, may be used depending upon the size and complexity of the required tasks. Suitable computers include mainframe computers, multiprocessor computers, workstations or personal computers.

In use, the computer-executable process steps according to the present invention typically initially are stored in mass storage 168, downloaded from mass storage 168 to RAM 156, and then executed by microprocessor 152 out of RAM 156. The process steps according to the present invention may also be stored on any form of computer-readable medium, including solid state memory devices such as RAM and ROM, optical storage devices such as CD-ROM and DVD, and magnetic storage devices such as hard disks, floppy disks, magnetic tapes and others.

Also connected to Internet backbone 50 is a hub 60. As discussed in more detail below, one function performed by the hub 60 is to retrieve messages sent over the Internet 50, process those instructions, and communicate with a central home controller. For this purpose, hub 60 also is connected to wide area network (WAN) 70.

Although terminals 31 and 32 are shown in FIG. 10 as being attached to hub 60 via the Internet 50, other methods can also be used for communicating between remote terminals and the hub, such as by utilizing a direct modem/telephone line dial-in connection, a wide area network, a local area network (LAN), or any other communication system. Furthermore, different terminals may be connected to hub 60 via different communication systems.

Preferably, the hub 60 will maintain a web site on the World Wide Web (WWW) serving as a host server, or may maintain a site that is connected through the Internet but not through the WWW. In this respect, the hub 60 functions as a web site host server.

It should be noted that a system implementing the present invention can be configured in many different ways and still be within the scope of the invention. The specific embodiments described herein are examples only.

The computer directly connected to the exercise machine can compile information for a specific individual's workout on the machine, thereby providing a recommended workout based on one or more past workouts for each exercise performed. This can also be accomplished by another computer on the network. For example, if it appears that a user has been improving his or her fitness with each use, the computer might suggest a more vigorous workout. Similarly, if it appears that there has been a long time since the last workout, it might recommend an easier workout.

Readily available heart-rate monitors, and other medical sensors could be attached to the machine, so the user, and even doctors could access a variety of medical conditions at specific points during a person's workout. All of this information, using computer networking, could be made available to any point in the world using the Internet or direct network connections whether via hard wire or wireless connections. And, as a result, this could be done in real-time, as the person is working out, or saved for later review.

Using the concept of real-time data acquisition, a variety of comparison events could be created where two or more people within one location compete during a workout, or teams could be created within a particular location, or different locations could compete. A system that takes into account a persons age, weight, sex, and other possible factors could be generated so that a point system could equalize a person's general physical potential—much like a handicap system in golf. Thus, the competitions would always be on "fair" terms. This would lead to a person's enjoyment during a workout—whether competing against themselves or others, it will always provide a fresh environment for exercise.

It would also be possible for a trainer, doctor or other qualified person to vary one's workout in real-time. This would allow for the trainer, doctor or other qualified person to vary the workout as an individual exercises as a result of their performance, as a need for variety, in a need to keep competitions actually balanced (no cheating on the handicap), or any other reason a qualified person deems necessary. The user will, of course, be able to vary his/her workout at any time for any reason—but the machine will always be giving feedback to the data acquisition so exercise can always be monitored. An example of how a trainer/instructor might do this would be to run a group exercise class and vary the cardiovascular workout for one, some or all of the participants during the exercise directly from his machine or computer. An example of how a doctor might utilize this would be to vary a person's workout based upon their blood pressure or heart rate, or any other factor that the sensors are sending. The doctor could do this from his office while the patient is at a rehabilitation facility, health club, or even working out on this machine at his/her house. These are just two of endless examples of how this technology could be used.

Due to the fact that this information can be stored and accessed anywhere in the world, it would be possible to pull up one's personal data at any machine, anywhere in the world. One would never need to take their workout with them. A person's relevant information could be accessed at any time. They could have the exact same workout at any facility that had this machine. A personal trainer or doctor would be able to ensure a safe, effective workout or treatment, even if they weren't their regular trainer or doctor, because their "chart" would always be with them. Additional individual information could also easily be input at the machine, or at the convenience of one's personal access to the Internet, resulting in the compilation of extensive data. This could help lead to healthier and more productive lives for anyone using the machine and all of its capabilities. Nutritional information such as daily diet, as well as work habits, rest and sleep habits, and any imaginable human characteristic could be entered on a regular basis. Then one could correlate that to specific workouts. Comparing strength building and cardio vascular exercises performed on the machine to the performance of heart-rate, and other medical data, and the other human characteristics previously mentioned. The data acquisition during one's workout could be so detailed as to record each movement they make, and how they performed it. It would then be possible to determine how the other human factors contributed to the whole workout, and even daily life. Did diet, sleep, time-of-workout, to name a few, really have an effect? And what should be changed so a person has more energy, or can be more productive. The limits simply do not exist as to how this machine and its' unique characteristics all within one machine could positively effect a person's life. This information could be transmitted to and from health care providers, independent testing labs, physical rehabilitation facilities, health clubs or any other necessary locations so that information regarding what a person has done, or what a person should do can be accessed and/or addressed in real-time. This will allow, for the first time, a direct actuarial connection between how one is living their life, and how it affects their scientifically measurable health such as, but not limited to, blood pressure, heart rate, cholesterol, blood oxygenation, body temperature, metabolism, injury recovery periods and general health. The result could be the connection between health care providers and their costs. A health care provider would actually be able to determine which exercises, from general to very specific, are best for individual. Then they could monitor a specific individual's habits and workout patterns via the network connections/Internet, and adjust monthly premiums based on how healthy they are actually living.

Due to the fact that each side of the machine is controlled independently, the machine would be invaluable to the medical industry for the purpose of rehabilitation. Example would be the best way to describe this. If a person had hurt their knee, they would need to workout their injured leg using a very limited resistance, increasing until full strength was achieved. Using this machine, one could continue to work one's non-injured leg at the same time, during the same exercise—keeping one's workout time as short as possible without sacrificing quality. This would mean they would be able to workout very efficiently, and have the benefit of not being stuck focusing on the pain of rehabilitation. This person could work their whole body out without having to move from location to location, getting both a higher resistance muscle building workout, and a lower resistance cardiovascular workout. They could work the muscles to support the knee, and then do a cardiovascular workout targeting their upper body using the 360-degree rotation available to any movement—upper or lower body. Again, all of this specific data such as the specific angles in range of motion and resistance levels that an individual is improving as they progress in physical rehab. They could determine if there are any problems within that range of motion as well using the on-board sensors.

Due to the fact that all machines around the world will, in effect, be connected via networks and/or the Internet, it would be possible to update any machine with new software, workout data, user interfaces, real-time news and images, video and audio data, and many other utilities to improve one's workout experiences or connection with health care organizations.

Another way to apply the data acquisition and unlimited flexibility of the machine to improve performance could be to get so specific as to adjust the resistance at very precise points of rotation. An example might be to strengthen muscles for kicking a football. One could have the machine provide a certain resistance through the user's motion, and then at a particular point increase the resistance momentarily as to mimic the additional force of coming into contact with the football. In addition, the users could train very specifically, discovering what workouts provide for optimum game/competition performance. The use could keep track of factors such as sleep, diet, daily psychological stress levels in addition to all of the data the machine can record during a workout. In the end, one could track what factors contributed to the best performances and structure one's entire life around getting the best performance.

The combination of the "Total Body Fitness Machine's" completely unique combination of 360-degree rotation, independently and infinitely variable resistance in either direction, and networked real-time data acquisition provides for a never before considered integration of one's complete lifestyle, habits, and exercise levels to one's is actual health, providing the possibility for people to be healthier and more productive throughout their complete day.

A networked fitness machine could also be used by insurance companies to offer discounts for those individuals who exercise regularly. For example, a health insurance company might offer a discount to those who exercise at least three times a week for at least 48 weeks a year. Perhaps if the individual achieves this goal (or some other goal set out by the insurance company), the individual would receive a refund for a portion of the premiums paid during the year. In this regard, the user could sign in with the machine when he or she exercises. The computer attached to the machine would forward information about the workout (such as the identity of the user, the length of the workout, the date of the workout, the average heart rate of the user during the workout, etc.) to the insurance company via the network. If the user's various workouts (as monitored by the insurance company) met the goal, the discount would be given to the user. In addition, the user's personal information, habits and other related information would be available to the insurance which would help in the insurance company's actuarial study of health. This could lead to benefits in treatments, and perks for the user.

Accordingly, the scope of the invention should be determined not by the embodiment(s) illustrated, but by the appended claims and their legal equivalents.

I claim:

1. A body fitness machine comprising; a frame; a first resistance mechanism attached to said frame; a setting means for setting the resistance of said resistance mechanism, said setting means permitting a user, prior to using, or at any time during use, of said fitness machine, to set a first resistance and at least a second resistance concurrently wherein the magnitude of said first resistance is independent of the magnitude of said second resistance; and a first lever arm operationally connected to said first resistance mechanism which provides a means with which to rotate said first resistance mechanism against said first and second resistances, wherein the fitness machine is configured such that the user first experiences said first resistance and then experiences said second resistance so as to mimic the striking of an object.

2. A body fitness machine comprising; a frame; a first resistance mechanism attached to said frame; a setting means for setting the resistance of said resistance mechanism, said setting means permitting a user, prior to using, or at any time during use, of said fitness machine, to set a first resistance; a first lever arm operationally connected to said first resistance mechanism which provides a means with which to rotate said first resistance mechanism against said first resistance; a second resistance mechanism attached to said frame; a second lever arm operationally connected to said second resistance mechanism, wherein said setting means permits the user to set a second resistance for said second resistance mechanism; wherein the setting of said second resistance does not affect the operation of said first resistance mechanism, wherein said setting means permits the user to set said second resistance concurrently with setting said first resistance; and, wherein said first resistance can be set to be different from said second resistance.

3. The body fitness machine recited in claim 2 wherein said first lever arm can be continually rotated 360 degrees while in use.

4. The body fitness machine recited in claim 2 wherein the machine is connected to a computer network whereby a person other than the user can adjust said first and second resistances via the computer network in a remote location.

5. The body fitness machine recited in claim 4 wherein said person can adjust said first and second resistances via the computer network while the machine is in use.

6. The body fitness machine recited in claim 2 wherein said setting means permits the user to set a third resistance and a fourth resistance concurrently with the setting of said first and second resistances.

7. The body fitness machine recited in claim 6 wherein said first lever arm can rotate in a first direction and in a second direction and said first resistance is applied when said first lever arm is moving in said first direction and said third resistance is applied when said first lever arm is moving is said second direction.

8. The body fitness machine recited in claim 6 wherein said first and second resistances can be set to be different from said third and fourth resistances.

9. The body fitness machine recited in claim 2 wherein said first resistance mechanism is operatively connected to a first hand crank and said second resistance mechanism is operatively connected to a second hand crank.

10. The body fitness machine recited in claim 2 wherein said first resistance mechanism is operatively connected to a first foot crank and said second resistance mechanism is operatively connected to a second foot crank.

* * * * *